United States Patent [19]

Kühnert

[11] 4,448,045

[45] May 15, 1984

[54] SLIDER NEEDLE

[75] Inventor: Gottfried Kühnert, Aalen, Fed. Rep. of Germany

[73] Assignee: Universal Maschinenfabrik Dr. Rudolf Schieber GmbH & Co. KG, Westhausen, Fed. Rep. of Germany

[21] Appl. No.: 450,697

[22] Filed: Dec. 17, 1982

[30] Foreign Application Priority Data

Dec. 23, 1981 [DE] Fed. Rep. of Germany ..... 3151150

[51] Int. Cl.[3] ..... D04B 35/04

[52] U.S. Cl. ..... 66/120

[58] Field of Search ..... 66/120

[56] References Cited

U.S. PATENT DOCUMENTS 189,501 4/1877 Salisbury ..... 66/120

3,449,930 6/1969 West et al. ..... 66/120 X

*Primary Examiner*—Ronald Feldbaum

*Attorney, Agent, or Firm*—Sughrue, Mion, Zinn, Macpeak, and Seas

[57] ABSTRACT

A slider needle for knitting machines, particularly flat knitting machines, comprises a needle body with needle hook and at least one needle butt, and a slider equipped with slider foot and mounted to be displaceable relative to the needle body. In order to ensure trouble-free and reliable separation of the old stitches from newly laid yarn a short swivel detent is mounted on the needle body behind the needle hook. The length and shape of this swivel element is chosen so that in the normal position of the needle, with the needle hook closed by the slider, the swivel detent is masked by the slider in the vertical direction, while when the needle hook is open the swivel detent projects proud of the needle body and above the slider in both its end positions.

5 Claims, 5 Drawing Figures

SLIDER NEEDLE

FIELD OF THE INVENTION

This invention relates to a slider needle for knitting machines, particularly flat knitting machines, comprising a needle body with needle hook and at least one needle butt, and a slider with slider butt mounted to be displaceable relative to the needle body.

Various different types of needle are known for use on textile machines to create stitches, such as point needles, latch needles and slider needles.

It has been conventional until now to use latch needles for flat knitting machines. Latch needles have the disadvantage however that the latch is a loose, freely movable element which is held in the desired position or is moved into the desired position with the aid of brushes, magnets, latch openers in the form of hooks or plates and latch closers. Because of the length of the latches, which for stitch considerations must be commensurate with the height of the needle hooks, relatively large needle paths have to be covered in the formation of stitches, when making tuck stitches and in the transfer of stitches. The length of the needle path for its part determines the size of the cam elements, and consequently the size of the knitting and transfer jacks and the size and the weight of the carriage.

The use of the slider needles would it is true considerably reduce the length of the needle paths, since the needle head is automatically controlled by the slider and is opened and closed with small needle movements and only has to be open during the laying of the yarn, remaining closed for the rest of the time. Nevertheless, the problem arises that, in the laying of the yarn particularly in the first needle after the reversal of the carriage, the newly laid yarn comes to lie very tightly against the old stitch and the slider is only able to separate the old stitch from the newly laid yarn with difficulty and unreliably as it slides over and traps the laid yarn.

SUMMARY OF THE INVENTION

It is an object of the present invention to provide a slider needle of the type first referred to above which enables one to achieve trouble-free separation of the newly laid yarn from the old stitches without hindering the knitting and the transfer of stitches.

This object is achieved in accordance with the present invention in that a short swivel detent is mounted on the needle body behind the needle hook, the length and shape of this swivel detent being selected so that in the normal position of the needle with the needle hook closed by the slider the swivel detent is masked by the slider in each of its pivoted end positions, whereas with the needle hook open the swivel detent projects proud of the needle body and above the slider in both its end positions. The range of pivotal movement of the swivel detent is kept very small.

The short swivel detent, which is preferably formed as a triangular element, ensures that the old stitch is separated quite definitely from the newly laid yarn without trouble, ensures that the separation remains, and that the old stitch can be slidingly pushed over the closed needle hook by the slider without difficulty on closure of the needle hook, and that the newly laid yarn can be formed into stitches. Consequently, one can not only reduce the weight of the carriage and the width of the needle beds, but the operational speed of the knitting machine can be considerably increased in comparison with knitting machines which use latch needles.

The swivel or pivoted position of the short swivel detent plays no part in the laying of the new yarn. The swivel detent is pivoted automatically by a needle loaded with a stitch, and with an empty needle can be pivoted back by the friction of the slider in its reciprocating movement.

The slider preferably comprises two webs which lie to the left and to the right of and in contact with the swivel detent. The two webs of the slider can be connected to each other in the region of the slider butt.

Alternatively, the slider can be made in one piece which is slotted in the forward region to form two side pieces, or it can be made from two identical side pieces and a short central distance piece.

Advantageously, the slider comprises a stitch support against which the stitches rest when the slider is extended.

The two webs or side pieces of the slider are preferably capable of being deflected apart by the needle hook. When the needle body is in the normal, i.e. jack-synchronous, position and the slider is extended for transferring the stitches, the two slider webs are bent apart from each other with the stitches hanging thereon, and consequently the stitches are spread for the better insertion of a reciprocal needle which slides in between the two slider webs or side pieces.

BRIEF DESCRIPTION OF THE DRAWINGS

A preferred embodiment of slider needle in accordance with the invention will now be described by way of example and with reference to the drawing. In the drawing.

DESCRIPTION OF THE PREFERRED EMBODIMENT

Figure 1:
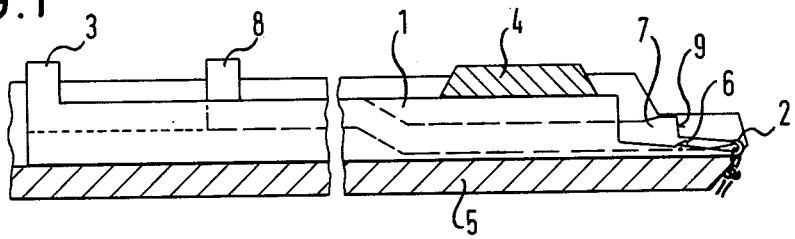
FIG. 1 shows the slider needle in the needle bed of a flat knitting machine, with the needle in the normal position, i.e. jack-synchronous position, and with the needle hook closed.

The slider needle of the present invention comprises a needle body 1 with a needle hook 2 at the forward end and with at least one needle butt 3 at the rearward end. The needle is held in a needle bed 5 by a bar 4. Behind the needle hook 2 there is mounted a short swivel detent 6 which is preferably triangular in shape and which can be flipped back and forth between two end positions. A slider 7 is mounted on the needle body 1 for displacement along the needle body and this slider is provided with a slider butt 8. The slider 7 preferably comprises two webs which abut against the respective opposite left-hand and right-hand sides of the short swivel detent 6 and can easily be bent apart by the needle hook 2. The slider 7 also has a stitch support 9. The two webs of the slider 7 are preferably connected to each other in the region of the slider butt 8. The needle hook 2 is opened and closed by the displacement of the slider 7 relative to the needle body 1. The needle butt 3 and the slider butt 8 are actuated by corresponding cam elements on the carriage.

The slider 7 can alternatively be made in one piece which is slotted in the forward part to form two side plates, or else it can be made from two identical side plates and a short central distance piece in the region of the slider butt 8.

The short swivel detent 6 is arranged and formed in such a way that in the normal position of the needle, with the needle hook 2 closed by the slider 7, the swivel detent is covered or masked by the slider 7 in either pivoted extreme position of the detent, whereas with the needle hook open the swivel detent projects proud of the needle body and above the slider in both its end positions. The purpose of the swivel detent 6 is to ensure reliable and trouble-free separation of an old stitch 10 from a newly laid yarn 11. When the needles are carrying stitches the short swivel detent 6 is pivoted automatically, and with empty needles the short swivel detent 6 can be pivoted back and forth by friction of the two webs or side plates of the slider 7 in its movement relative to the needle body 1.

Figure 2:
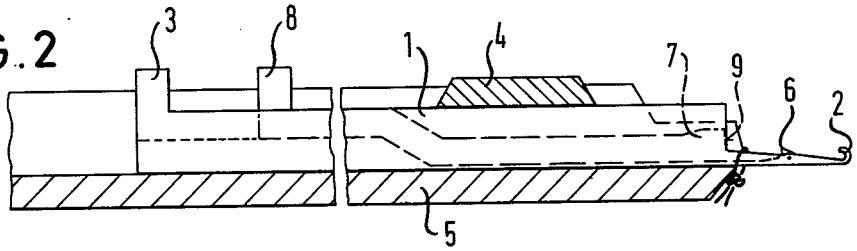
FIG. 2 shows the slider needle of FIG. 1 with the needle extended for the formation of a stitch.
Figure 3:
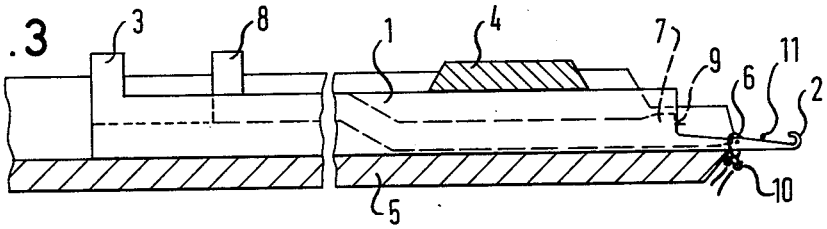
FIG. 3 shows the slider needle of FIG. 1 with a new yarn being laid.

With the needle set in the normal position, i.e. the jack-synchronous position, shown in FIG. 1, the needle hook 2 is closed by the slider 7. Upon extension of the needle for the formation of a stitch (FIG. 2) the slider 7 remains stationary until the needle hook 2 is open. Upon the further extension of the needle the stitch 10 slides over the backwardly pivoted short swivel detent 6 and back on to the slider 7. The stitch 10 then lies behind the short swivel detent 6. Upon retraction of the needle the new yarn 11 (FIG. 3) is laid in front of the short swivel detent 6. The old stitch 10 and the new yarn 11 are thus separated from each other reliably and without difficulty by the short swivel detent but without the pivoted position of the detent playing any part in this.

Figure 4:
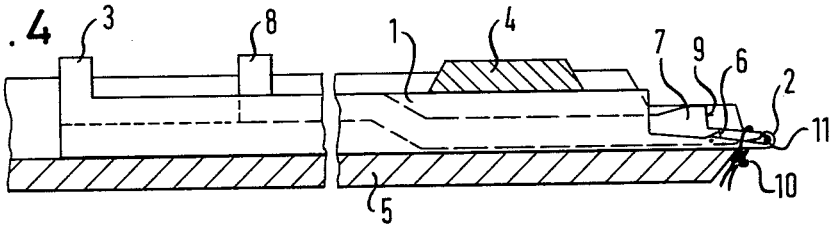
FIG. 4 shows the slider needle of FIG. 1 with the needle hook closed, with the old stitch hanging on the slider, and with the new yarn taken up by the needle hook; and, FIG. 5 shows the slider needle of FIG. 1 in the position for the transfer of a stitch.

The slider 7, which at least in its forward part comprises two webs which lie against the left and the right sides respectively of the short swivel detent 6, carries the old stitch 10 and now makes a short relative movement in relation to the needle body 1 until the needle hook 2 is closed (FIG. 4), the new yarn 11 lies within the needle hook 2, the old stitch pivots the short swivel detent 6 forwards as it is carried by the slider 7 over the closed needle hook 2, and the newly laid yarn 11 forms the new stitch (FIG. 1).

Figure 5:
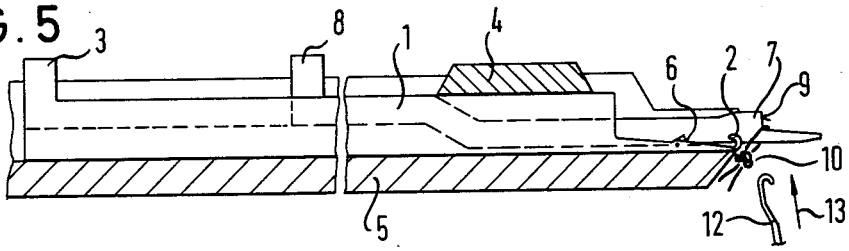

FIG. 5 shows the position in which a stitch 10 is to be transferred. The slider 7 is extended so far that its stitch support 9 brings the stitch 10 into the pickup range of a reciprocal needle 12. The needle body 1 is in the normal, i.e. jack-synchronous, position and the two webs or side plates of the slider 7 which in their forward sliding movement slide past the needle hook 2 to the left and to the right of the hook are bent apart easily by the hook and consequently the stitch 10 is spread apart for easier insertion of the reciprocal needle 12. The reciprocal needle 12 is then moved in the direction of the arrow 13 between the webs or side plates of the slider 7.

I claim:

1. A slider needle for knitting machines, particularly flat knitting machines, comprising a needle body with needle hook and at least one needle butt, and a slider with slider butt mounted to be displaceable relative to the needle body, in which a short swivel detent is mounted on the needle body behind the needle hook, the length and shape of the swivel detent being selected so that in the normal position of the needle with the needle hook closed by the slider the swivel detent is masked by the slider in each pivoted end position of the detent, whereas with the needle hook open the swivel detent projects proud of the needle body and above the slider in its two end positions.

2. A slider needle according to claim 1, in which the swivel detent is triangular.

3. A slider needle according to claim 1, in which the slider comprises two webs which lie to the left and to the right, respectively, of and against the swivel detent, and the two webs of the slider are connected to each other in the region of the slider butt.

4. A slider needle according to claim 1, in which the slider is made in one piece which is slotted in its forward region to form two side pieces.

5. A slider needle according to claim 1, in which the slider comprises two identical side pieces and a short central distance piece.

* * * * *